US012789074B2

(12) United States Patent
Cai et al.

(10) Patent No.: US 12,789,074 B2
(45) Date of Patent: Nov. 10, 2026

(54) ELECTRONIC REFEREEING SYSTEM AND ELECTRONIC REFEREEING METHOD FOR BOXING, AND STORAGE MEDIUM

(71) Applicant: NANJING XEMPOWER SPORTS TECHNOLOGY CO., LTD., Nanjing (CN)

(72) Inventors: Jiyao Cai, Nanjing (CN); Yongjun Cai, Nanjing (CN)

(73) Assignee: NANJING XEMPOWER SPORTS TECHNOLOGY CO., LTD., Nanjing (CN)

( * ) Notice: Subject to any disclaimer, the term of this patent is extended or adjusted under 35 U.S.C. 154(b) by 302 days.

(21) Appl. No.: 18/685,641

(22) PCT Filed: Nov. 22, 2022

(86) PCT No.: PCT/CN2022/133441
§ 371 (c)(1),
(2) Date: Feb. 22, 2024

(87) PCT Pub. No.: WO2023/098516
PCT Pub. Date: Jun. 8, 2023

(65) Prior Publication Data

US 2024/0350892 A1 Oct. 24, 2024

(30) Foreign Application Priority Data

Dec. 2, 2021 (CN) ..... 202111462731.4

(51) Int. Cl.
*A63B 71/06* (2006.01)

(52) U.S. Cl.
CPC ..... *A63B 71/0669* (2013.01); *A63B 71/0605* (2013.01); *A63B 71/0622* (2013.01);
(Continued)

(58) Field of Classification Search
CPC ..... A63B 71/0669; A63B 71/0605; A63B 2071/0625; A63B 2220/62;
(Continued)

(56) References Cited

U.S. PATENT DOCUMENTS 10,646,154 B2 * 5/2020 Merchant-Borna ..... A61B 5/11
2024/0424373 A1 * 12/2024 Merrell ..... G01L 5/0052

FOREIGN PATENT DOCUMENTS

CN 208212473 U 12/2018
CN 209060481 U 7/2019
(Continued)

OTHER PUBLICATIONS

Decision of Refusal for Chinese Application No. 202111462731.4 mailed Nov. 23, 2022.
(Continued)

*Primary Examiner* — Jeffrey K Wong
(74) *Attorney, Agent, or Firm* — Ballard Spahr LLP

(57) ABSTRACT

An electronic refereeing system and method for boxing; and a storage medium are provided. The system includes a sensing module, a monitoring module, a comprehensive scoring module, a remote transmission module, and a main control system. The main control system is connected to the comprehensive scoring module through the remote transmission module, and the comprehensive scoring module is connected to the sensing module and the monitoring module, where the sensing module is configured to perform scoring according to a strike intensity, then the monitoring module is configured to perform scoring according to a captured strike point, and finally the comprehensive scoring module is configured to perform comprehensive calculation on a score of the sensing module and a score of the monitoring module in a weight calculation manner. In the refereeing method, the strike point and the strike intensity
(Continued)

are comprehensively considered, so a more objective evaluation can be made.

16 Claims, 7 Drawing Sheets

(52) U.S. Cl.
CPC ... *A63B 2071/0625* (2013.01); *A63B 2220/62* (2013.01); *A63B 2220/836* (2013.01); *A63B 2225/50* (2013.01); *A63B 2244/102* (2013.01)

(58) Field of Classification Search
CPC ..... A63B 2220/836; A63B 2225/50; A63B 2244/102; A63B 71/0622
See application file for complete search history.

(56) References Cited

FOREIGN PATENT DOCUMENTS

| | | | |
|---|---|---|---|
| CN | 111097160 | A | 5/2020 |
| CN | 111973971 | A | 11/2020 |
| CN | 114042304 | A | 2/2022 |
| WO | 2014104828 | A3 | 7/2014 |

OTHER PUBLICATIONS

First Office Action for Chinese Application No. 202111462731.4 mailed Jun. 28, 2022.
International Search Report and Written Opinion for International Application No. PCT/CN2022/133441 mailed Feb. 7, 2023.
Second Office Action for Chinese Application No. 202111462731.4 mailed Oct. 14, 2022.

* cited by examiner

ELECTRONIC REFEREEING SYSTEM AND ELECTRONIC REFEREEING METHOD FOR BOXING, AND STORAGE MEDIUM

CROSS-REFERENCE TO RELATED APPLICATIONS

This application is a U.S. National Stage Application, filed under 35 U.S.C. 371, of International Patent Application No. PCT/CN2022/133441, filed on Nov. 22, 2022, which claims priority to Chinese Patent Application No. 202111462731.4, filed on Dec. 2, 2021, and entitled "ELECTRONIC REFEREEING SYSTEM FOR BOXING", the entire contents of which are incorporated herein in their entireties.

TECHNICAL FIELD

The present disclosure relates to the field of refereeing systems, and in particular, to an electronic refereeing system and electronic refereeing method for boxing, and a storage medium.

BACKGROUND

Boxing is a sport in which an athlete needs to wear boxing gloves to fight. The sport includes both an amateur match and a professional match (for example, Olympic boxing). In a boxing match, an athlete needs to strive to avoid strikes of an opponent, and score more points than the opponent or knock the opponent out to win the match. In a conventional boxing match, a referee needs to perform comprehensive evaluation and scoring on a position of a strike point and a strike intensity, and then a final score is obtained through comprehensive scoring of a plurality of referees. As a result, a major subjective factor exists. Therefore, a major problem exists for fairness of judgment, and even a situation of bribing a referee and playing a false match may occur. For a situation in which a plurality of matches are played simultaneously, in a conventional method, scoring of matches in arenas is managed and controlled disorderedly, it is difficult to perform overall grasping, and it is necessary to learn statuses of the matches in time; and after the plurality of matches end, parties need to collect statistics before announcing a result uniformly and arranging subsequent matches.

SUMMARY

Based on this, it is necessary to provide an electronic refereeing system and method for boxing, and a storage medium for the foregoing technical problem.

According to a first aspect, this application provides an electronic refereeing system for boxing, including a sensing module, a monitoring module, a comprehensive scoring module, a remote transmission module, and a main control system, where the main control system is connected to the comprehensive scoring module through the remote transmission module, and the comprehensive scoring module is connected to the sensing module and the monitoring module, where

- the sensing module is configured to detect a strike intensity and perform scoring on the strike intensity;
- the monitoring module is configured to determine a strike point and perform scoring on the strike point; and
- the comprehensive scoring module is configured to perform comprehensive calculation on a score of the sensing module and a score of the monitoring module in a weight calculation manner.

Optionally, the sensing module includes an intensity scoring module and a strike intensity detection module; and the strike intensity detection module is connected to a sensor mounted in a boxing glove and is configured to receive a strike intensity sensed by the sensor, and the intensity scoring module is configured to perform scoring according to the strike intensity.

The strike intensity detection module is configured to receive a strike intensity value sensed by the sensor, and in response to receiving a strike intensity value which exceeds a first preset threshold, send a current strike intensity value to the intensity scoring module; and send a current time stamp to the monitoring module to perform image capture.

The intensity scoring module in which a plurality of strike intensity thresholds are set is configured to select a score corresponding to a maximum strike intensity threshold reached or exceeded by a strike intensity value as a score of a current strike, and output the score of the strike intensity to the comprehensive scoring module. Optionally, the monitoring module includes a body contour scanning module, a strike point marking module, a score review module, and a strike point score record module, where

- the body contour scanning module is configured to capture an image in real time according to a received time stamp and scan the image to find a body contour;
- the strike point marking module is configured to mark a strike point according to the captured image and based on the body contour found by scanning of the body contour scanning module;
- the score review module is configured to perform scoring according to the marked strike point; and
- the strike point score record module is configured to record the strike point and a score corresponding to the strike point, and output the score of the strike point to the comprehensive scoring module.

The score review module is configured to divide the body contour found by scanning of the body contour scanning module into a plurality of preset parts for, perform parameter setting on each preset part, select a closest preset part according to the received strike point to obtain a corresponding parameter that is a strike point score, and send the strike point and the corresponding strike point score to the strike point score record module. Optionally, the comprehensive scoring module includes a weight calculation module, a manual check module, and a final score output module, where the weight calculation module is configured to perform weight calculation according to the score of the strike intensity of the sensing module and the score of the strike point of the monitoring module to obtain a comprehensive score, the manual check module is configured to help a referee intervene in determining a reasonable extent of the comprehensive score to prevent a problem of an excessively large error from occurring, and the final score output module is configured to output a finally checked score.

A basis of determining the reasonable extent is considering, in a case that a difference between a manually given score and a score given by the comprehensive scoring module is in a first predetermined range, the score given by the comprehensive scoring module to be reasonable.

Optionally, the weight calculation module includes a weight input module, and the weight input module is configured to assist in manually inputting and calculating a weight coefficient of a strike intensity score and a weight coefficient of a strike point score.

Optionally, the main control system includes a display module, a voice module, and a storage module, the display module is configured to display a scoring result and a system running situation, the voice module is configured to broadcast prompt voice in a match, where the prompt voice includes a match time record, a score, a foul warning, match node broadcasting, and athlete information playing, and the storage module is configured to store data information.

Optionally, the main control system further includes an athlete registration module; and the athlete registration module includes a numbering module, a portrait input module, and a characteristic parameter input module, the numbering module is configured to number athletes, the portrait input module is configured to enter identity images of the athletes, and the characteristic parameter input module is configured to input characteristic parameters of the athletes, where the characteristic parameters include ages, heights, and weights.

Optionally, the main control system further includes an athlete data retrieving module, a score matching module, and a result output module, the athlete data retrieving module is configured to retrieve athlete data in the main control system, the score matching module is configured to perform matching between a comprehensive score of the comprehensive scoring module and athlete data, and the result output module is configured to simultaneously correspondingly output a score and athlete data that correspond to an athlete.

Optionally, the remote transmission module includes a Wireless Fidelity (Wireless Fidelity, Wi-Fi) module, and the Wi-Fi module is disposed between a data receive end and a data transmit end of the comprehensive scoring module and the main control system.

Optionally, the main control system includes a penalty module, the penalty module includes a violation item record module, a violation rating module, and a penalty amount calculation module, the violation item record module is configured to record a violation item according to an image captured and recorded by the monitoring module, the violation rating module is configured to perform rating according to the violation item, each rating corresponds to a different penalty amount, and the penalty amount calculation module is configured to perform summation according to a quantity of violation times and the penalty amount corresponding to each rating to obtain a final penalty amount.

According to a second aspect, this application provides an electronic refereeing method for boxing, where the refereeing method includes the following steps:

collecting a strike intensity value in real time;

determining whether the strike intensity value exceeds a first preset threshold, and continuing the refereeing method if the strike intensity value exceeds the first preset threshold, or otherwise returning to the collecting a strike intensity value in real time until the strike intensity value exceeds the first preset threshold;

performing scoring according to the strike intensity value;

capturing an image and obtaining a body contour based on the image;

determining a strike point according to the body contour;

giving a strike point score according to the strike point and the body contour; and outputting a comprehensive score with reference to weights and based on a score of the strike intensity value and the strike point score.

The performing scoring according to the strike intensity value includes:

setting a plurality of strike intensity thresholds;

comparing the received strike intensity value with the plurality of strike intensity thresholds; and outputting a score corresponding to a maximum strike intensity threshold reached or exceeded by a strike intensity value as a current strike score.

The giving a strike point score according to the strike point and the body contour includes:

dividing the body contour found by scanning into a plurality of preset parts;

performing parameter setting on each preset part; and selecting a closest preset part according to a received strike point to obtain a corresponding parameter that is a strike point score.

According to a third aspect, this application further provides a computer-readable storage medium. A computer program is stored on the computer-readable storage medium, and when the computer program is executed by a processor, the following steps are performed:

collecting a strike intensity value in real time;

determining whether the strike intensity value exceeds a first preset threshold, and continuing if the strike intensity value exceeds the first preset threshold, or otherwise returning to the collecting a strike intensity value in real time until the strike intensity value exceeds the first preset threshold;

performing scoring according to the strike intensity value;

capturing an image and obtaining a body contour based on the image;

determining a strike point according to the body contour;

giving a strike point score according to the strike point and the body contour; and outputting a comprehensive score with reference to weights and based on a score of the strike intensity value and the strike point score.

Compared with the existing technology, this application has the following beneficial effects:

1. This solution provides a more precise and fairer scoring manner, where the sensing module is configured to perform scoring according to a strike intensity, the monitoring module is configured to perform scoring according to a captured strike point, and the comprehensive scoring module is configured to perform comprehensive calculation on the score of the strike intensity and the score of the strike point in a weight calculation manner, to effectively consider a comprehensive situation of the strike point and the strike intensity, and give an objective score. Compared with a conventional manual and subjective scoring manner, the scoring method is more objective and reasonable, to help promote fair athletics.
2. A body contour is found by scanning a captured image, a strike point is marked based on the body contour, scoring is performed according to the marked strike point, and the strike point and a corresponding score are recorded, which is more precise for the score of the strike point and more objective and accurate compared with conventional scoring through observation with naked eyes, and is free of a score missing situation occurring due to negligence.
3. Weight calculation is performed on the score of the strike intensity and the score of the strike point to obtain a comprehensive score, and reasonableness of the comprehensive score can be determined, to prevent an excessively large error from occurring.
4. Degrees of importance for the score of the strike intensity and the score of the position of the strike point may be reasonably adjusted according to a requirement.

For example, corresponding weight coefficients are adjusted, so that comprehensive evaluation is more reasonable and scientific, and adjustment is flexible.

5. The main control system can enter and retrieve information about an athlete and related data, perform matching between the data of the athlete and a corresponding comprehensive score, and output the data of the athlete and a score of the corresponding athlete simultaneously, which may assist in managing a plurality of matches simultaneously. Because a score corresponds to an athlete definitely, group assignment of a next match may be determined after statistics are collected on results, which effectively improves management and control capabilities in a competition arena, increases efficiency, and saves athlete assignment in each arena.

BRIEF DESCRIPTION OF THE DRAWINGS

To describe the technical solutions in the embodiments of this application or in the conventional technology more clearly, the following briefly describes the accompanying drawings required for describing the embodiments or the conventional technology. Apparently, the accompanying drawings in the following description show merely some embodiments of this application, and a person of ordinary skill in the art may still derive other drawings from these accompanying drawings without creative efforts.

DETAILED DESCRIPTION

The following clearly and completely describes the technical solutions in the embodiments of this application with reference to the accompanying drawings in the embodiments of this application. Apparently, the described embodiments are merely some but not all of the embodiments of this application. Based on the embodiments in this application, all other embodiments obtained by a person skilled in the art without paying any creative efforts all fall within the protection scope of this application.

To make the present disclosure more comprehensible, detailed description is made to specific implementations of this application below with reference to the accompanying drawings. In the following description, many specific details are described for fully understanding this application. However, this application may be implemented in many other manners different from those described herein. A person skilled in the art may make similar improvements without departing from the connotation of this application. Therefore, this application is not limited to the specific embodiments disclosed below.

In the descriptions of this application, the terms such as "first" and "second" are used only for the purpose of description, and cannot be understood as indicating or implying the relative importance or implicitly specifying the number of the indicated technical features. Therefore, features defining "first" and "second" can explicitly or implicitly include at least one of the features. In the descriptions of this application, unless otherwise specified, "plurality of" means two or more than two.

In this application, unless otherwise explicitly specified and defined, terms such as "mounted", "connected", "connection", and "fixed" should be understood in broad sense, for example, the connection may be a fixed connection, a detachable connection, or an integral connection; or the connection may be a mechanical connection or an electrical connection; or the connection may be a direct connection, an indirect connection through an intermediary, or internal communication between two elements or a mutual action relationship between two elements, unless otherwise specified explicitly. A person of ordinary skill in the art can understand specific meanings of the foregoing terms in this application according to a specific situation.

Figure 1:
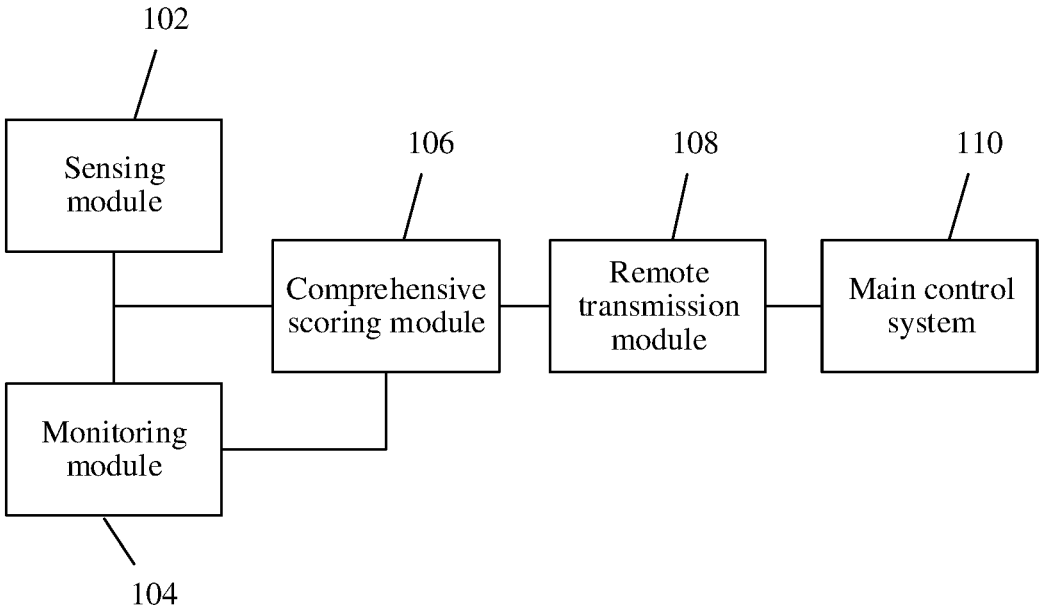
FIG. 1 is a schematic structural diagram of an electronic refereeing system for boxing according to the present disclosure.

As shown in FIG. 1, an electronic refereeing system for boxing in an embodiment of the present disclosure includes a sensing module 102, a monitoring module 104, a comprehensive scoring module 106, a remote transmission module 108, and a main control system 110. The main control system 110 is connected to the comprehensive scoring module 106 through the remote transmission module 108, and the comprehensive scoring module 106 is connected to the sensing module 102 and the monitoring module 104, where the sensing module 102 is configured to detect a strike intensity and perform scoring according to the strike intensity to obtain a score of the strike intensity; the monitoring module 104 is configured to determine a strike point and perform scoring according to the determined strike point to obtain a score of the strike point; and the comprehensive scoring module 106 is configured to perform comprehensive calculation on a score of the sensing module 102 and a score of the monitoring module 104 in a weight calculation manner. The remote transmission module 108 connected to the comprehensive scoring module 106 and the main control system 110 is configured to transmit data. The main control system 110 is configured to perform user interaction on a user side according to scoring data sent by the remote transmission module 108.

Figure 2:
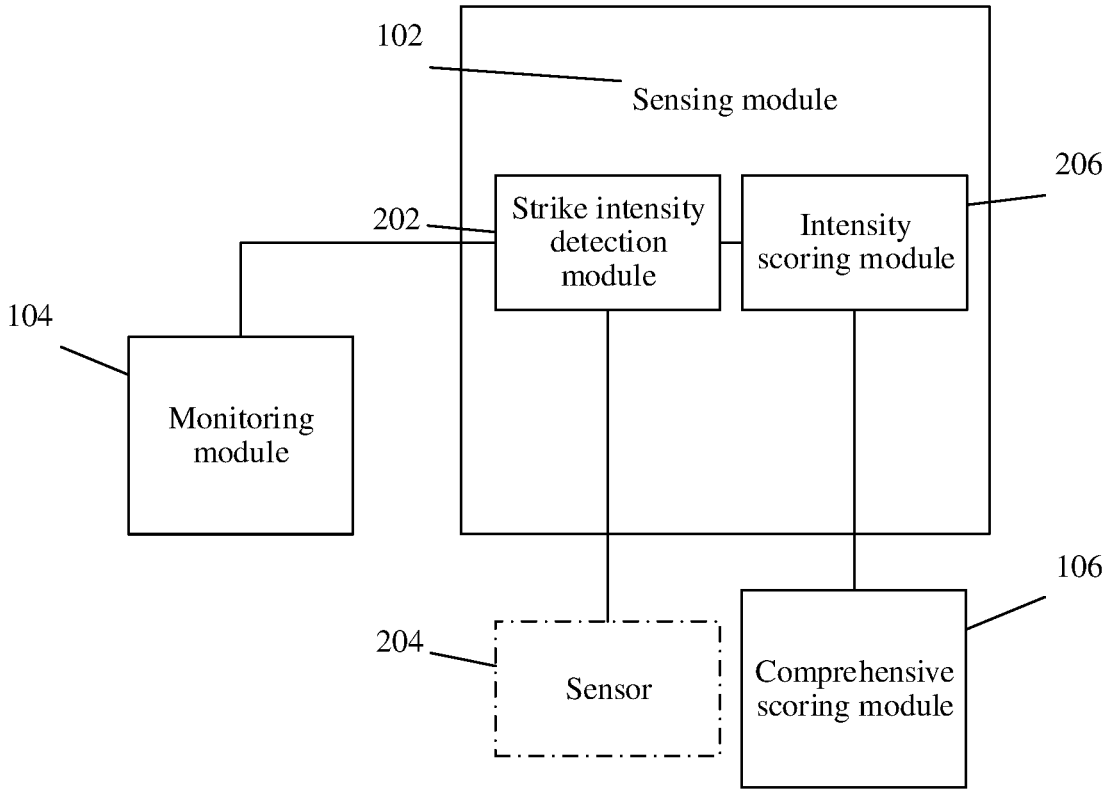
FIG. 2 is a schematic structural diagram of a sensing module of an electronic refereeing system for boxing according to this application.

As shown in FIG. 2, the sensing module 102 includes a strike intensity detection module 202 and an intensity scoring module 204, where the strike intensity detection module 202 is connected to a sensor 206, and the sensor 206 mounted in a boxing glove is configured to sense an intensity during a strike. In some optional embodiments, the sensor 206 is disposed in a position on the boxing glove corresponding to an outer side of a wrist; and the sensor 206 is configured to transmit the sensed strike intensity to the strike intensity detection module 202 through Bluetooth.

In some optional embodiments, the strike intensity detection module 202 is configured to receive, in real time, the strike intensity sensed by the sensor 206, determine whether the strike intensity exceeds a first preset threshold, mark the strike intensity at this moment as a valid strike intensity when the strike intensity exceeds the first preset threshold, send a time stamp at this moment to the monitoring module 104 to capture an image, and send the strike intensity value at this moment to the intensity scoring module 204. The intensity scoring module 204 is configured to perform scoring according to intensity magnitude.

In some optional embodiments, a plurality of strike intensity thresholds may be set. The intensity scoring module 204 is configured to compare the received strike intensity value with the plurality of strike intensity thresholds separately, select a score corresponding to a maximum strike intensity threshold reached or exceeded by a strike intensity value as a score of a current strike intensity, and output the score to the comprehensive scoring module 106.

Figure 3:
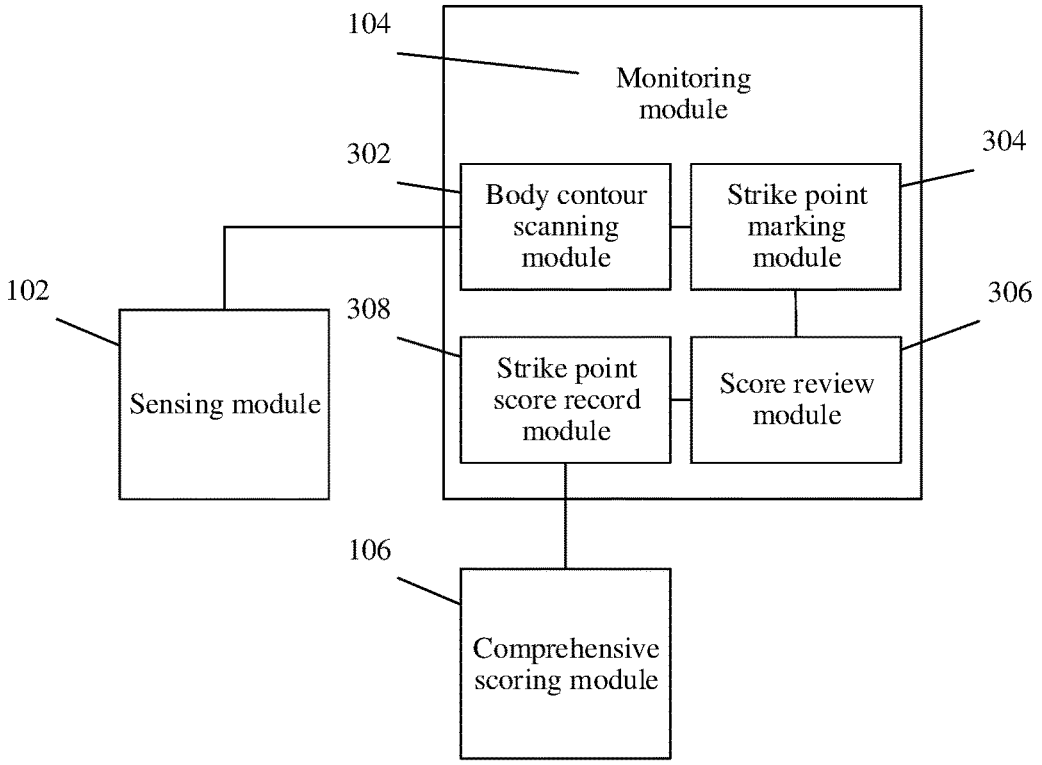
FIG. 3 is a schematic structural diagram of a monitoring module of an electronic refereeing system for boxing according to this application.

As shown in FIG. 3, the monitoring module 104 includes a body contour scanning module 302, a strike point marking module 304, a score review module 306, and a strike point score record module 308. The body contour scanning module 302 is configured to scan an image to find a body contour; the strike point marking module 304 is configured to mark a strike point based on the body contour found by scanning of the body contour scanning module; the score review module 306 is configured to perform scoring according to the marked strike point; and the strike point score record module 308 is configured to record the strike point and a corresponding score.

In some embodiments, the strike point marking module 304 is configured to determine a strike point from the body contour found by scanning the captured image, and send the determined strike point to the score review module 306. The strike point may be determined based on intelligent calculation. For example, the strike point is determined based on a neural network method, or the strike point may be determined from the captured image in a manual manner.

In some embodiments, the score review module 306 may be configured to divide the body contour found by scanning of the body contour scanning module 302 into a plurality of preset parts for, perform parameter setting on each preset part, and select a preset part closest to the marked point according to the strike point marked by the strike point marking module 304 to obtain a parameter corresponding to the preset part that is a strike point score; and send the strike point and the score to the strike point score record module 308 for recording after obtaining the score. The strike point score record module 308 is configured to record and then output the score to the comprehensive scoring module. In some optional implementations, a strike point score may be equal to a parameter corresponding to a preset part, or may be directly proportional to a parameter corresponding to a preset part.

Figure 4:
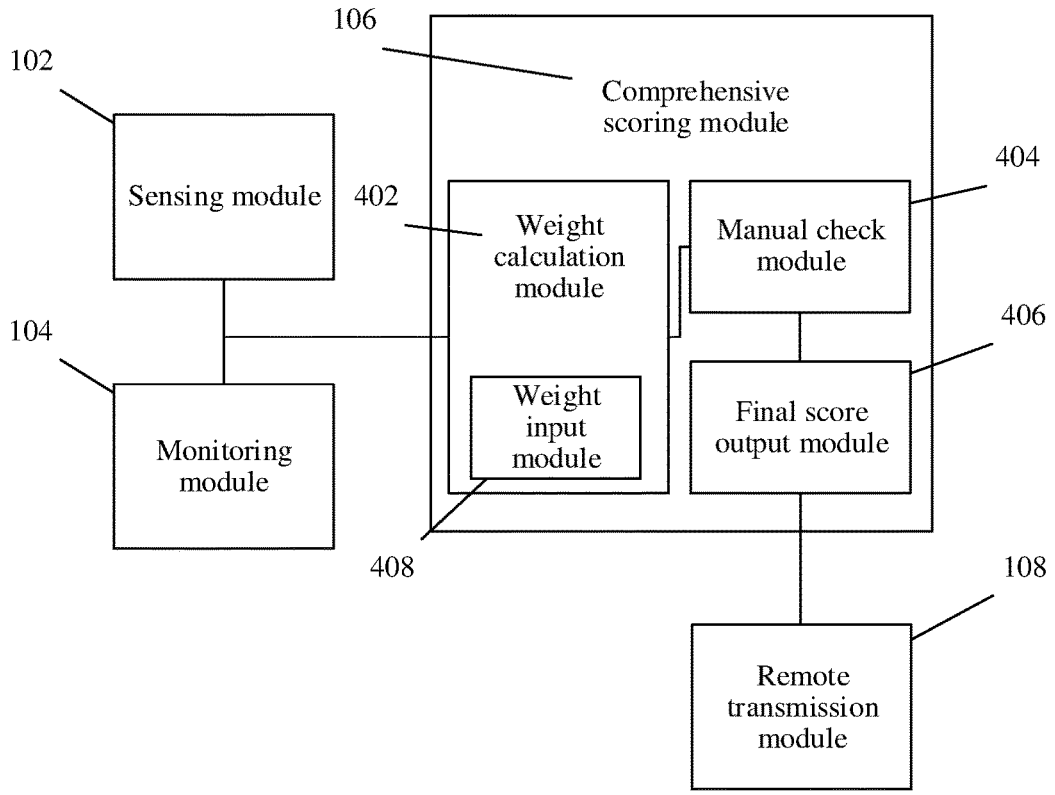
FIG. 4 is a schematic structural diagram of a comprehensive scoring module of an electronic refereeing system for boxing according to this application.

As shown in FIG. 4, the comprehensive scoring module 106 includes a weight calculation module 402, a manual check module 404, and a final score output module 406. The weight calculation module is configured to perform weight calculation according to the score of the strike intensity of the sensing module and the score of the strike point of the monitoring module to obtain a comprehensive score. The manual check module is configured to help introduce manual scoring to determine a reasonable extent of the comprehensive score to prevent a problem of an excessively large error from occurring. The final score output module is configured to output a checked score.

In some embodiments, a process of determining the reasonable extent may include: comparing the score given by the comprehensive scoring module with a manually given score, and considering, in a case that a difference between the manually given score and the score given by the comprehensive scoring module is in a first predetermined range, the score given by the comprehensive scoring module to be reasonable.

The weight calculation module 402 includes a weight input module 408, and the weight input module 408 is configured to input and calculate a weight coefficient of a strike intensity score and a weight coefficient of a strike point score.

Figure 5:
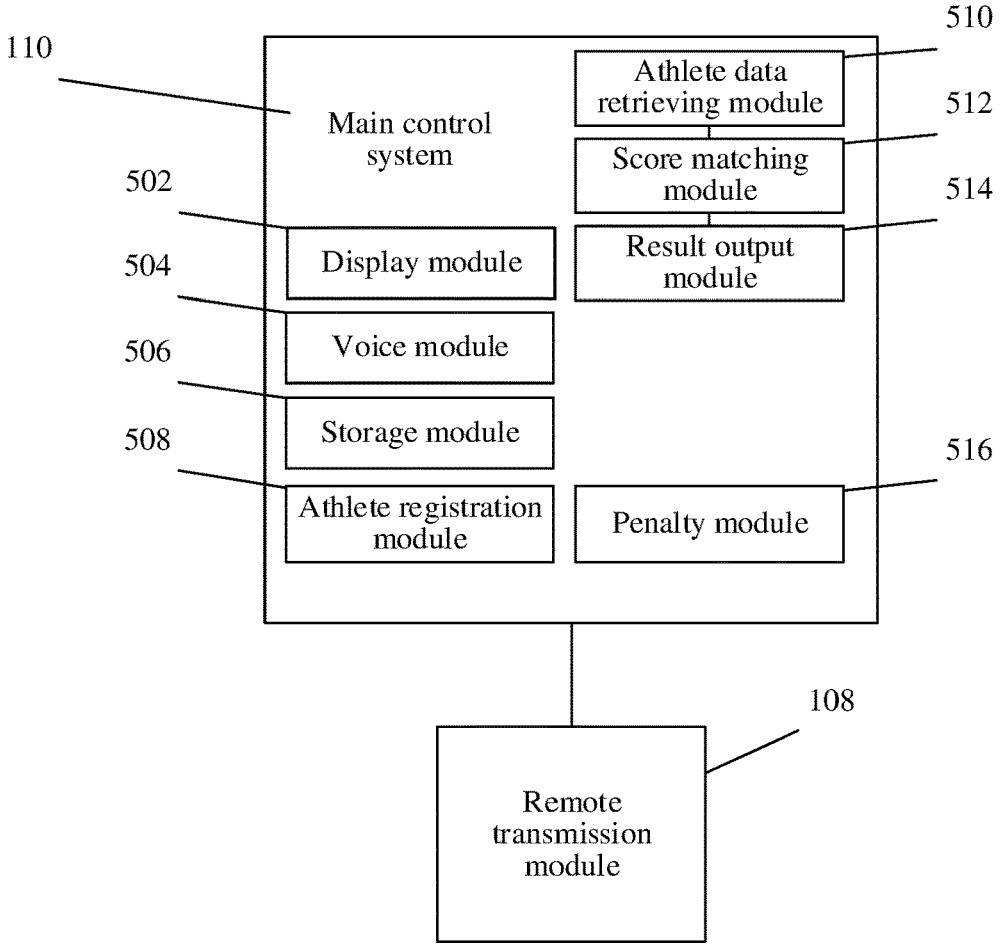
FIG. 5 is a schematic structural diagram of a main control system of an electronic refereeing system for boxing according to this application.
Figure 6:
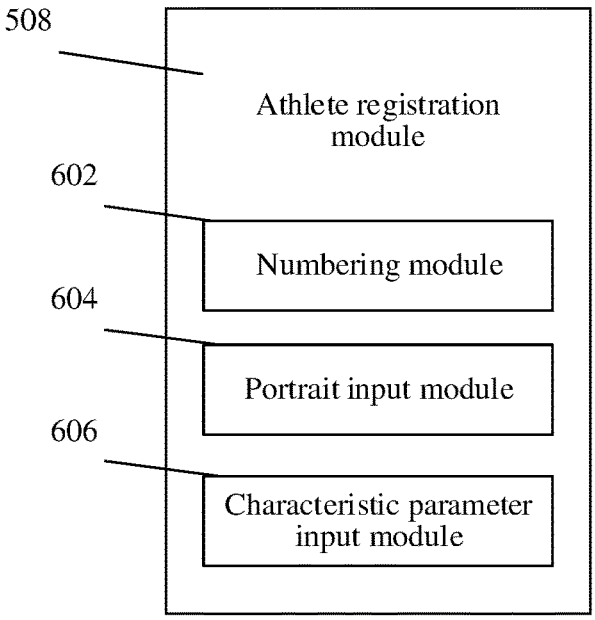
FIG. 6 is a schematic structural diagram of an athlete registration module in a main control system of an electronic refereeing system for boxing according to this application.
Figure 7:
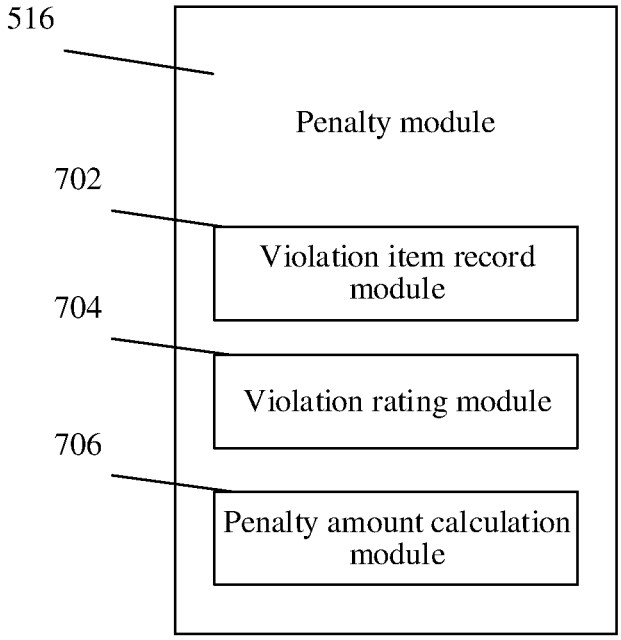
FIG. 7 is a schematic structural diagram of a penalty module in a main control system of an electronic refereeing system for boxing according to this application.

As shown in FIG. 5, the main control system 110 includes a display module 502, a voice module 504, and a storage module 506, the display module 502 is configured to display a scoring result and a system running situation, the voice module 504 is configured to broadcast prompt voice in a match, where the prompt voice includes a match time record, a score, a foul warning, match node broadcasting, and athlete information playing, and the storage module 506 is configured to store data information.

The main control system 110 may further include an athlete registration module 508. The athlete registration module includes a numbering module 602, a portrait input module 604, and a characteristic parameter input module 606, the numbering module 602 is configured to number athletes, the portrait input module 604 is configured to enter identity images of the athletes, and the characteristic parameter input module 606 is configured to input characteristic parameters of the athletes, where the characteristic parameters include ages, heights, weights, and the like.

The main control system 110 may further include an athlete data retrieving module 510, a score matching module 512, and a result output module 514, the athlete data retrieving module 510 is configured to retrieve athlete data in the main control system, the score matching module 512 is configured to perform matching between a comprehensive score of the comprehensive scoring module 106 and athlete data, and the result output module 514 is configured to simultaneously correspondingly output a score and athlete data that correspond to an athlete.

The remote transmission module 108 may include a Wi-Fi module, and the Wi-Fi module is disposed between a data receive end and a data transmit end of the comprehensive scoring module 106 and the main control system 110.

The main control system 110 includes a penalty module 516, the penalty module includes a violation item record module 702, a violation rating module 704, and a penalty amount calculation module 706, the violation item record module 702 is configured to record a violation item according to an image captured and recorded by the monitoring module 104, the violation rating module 704 is configured to perform rating according to the violation item, each rating corresponds to a different penalty amount, and the penalty amount calculation module 706 is configured to perform summation according to a quantity of violation times and the penalty amount corresponding to each rating to obtain a final penalty amount.

During use, this solution provides a more precise and fairer scoring manner, where the sensing module is configured to perform scoring according to a strike intensity, then the monitoring module is configured to perform scoring according to a captured strike point, and finally the comprehensive scoring module is configured to perform comprehensive calculation on scores of the sensing module and the monitoring module in a weight calculation manner, so as to effectively consider a comprehensive situation of the strike point and the strike intensity during scoring, and give an objective score. In addition, compared with a conventional manual and subjective scoring manner, the scoring method is more objective and reasonable, to help promote fair athletics. The body contour scanning module is configured to scan an image to find a body contour, the strike point marking module is configured to mark a strike point based on the body contour found by scanning of the body contour scanning module, the score review module is configured to perform scoring according to the marked strike point, and the strike point score record module is configured to record the strike point and correspondingly perform matching between the strike point and a score, which is more precise for the score of the strike point and more objective and accurate compared with conventional scoring through observation with naked eyes, and is free of a score missing situation occurring due to negligence. The weight calculation module is configured to perform weight calculation according to the score of the strike intensity of the sensing module and the score of the strike point of the monitoring module to obtain a comprehensive score, the manual check module is configured to help a referee intervene in determining a reasonable extent of the comprehensive score to prevent a problem of an excessively large error from occurring, and the final score output module is configured to output a finally checked score. The main control system further includes an athlete registration module; and the athlete registration module includes a numbering module, a portrait input module, and a characteristic parameter input module, the numbering module is configured to number athletes, the portrait input module is configured to enter identity images of the athletes, and the characteristic parameter input module is configured to input characteristic parameters of the athletes, where the characteristic parameters include ages, heights, weights, and the like. The athlete data retrieving module is configured to retrieve athlete data in the main control system, the score matching module is configured to perform matching between a comprehensive score of the comprehensive scoring module and athlete data, and the result output module is configured to simultaneously correspondingly output a score and athlete data that correspond to an athlete. The weight input module is configured to assist in manually inputting and calculating a weight coefficient of a strike intensity score and a weight coefficient of a strike point score. Therefore, degrees of importance for the score of the strike intensity and the score of the position of the strike point may be reasonably adjusted according to a requirement, that is, it is necessary to adjust only weight coefficients, so that comprehensive evaluation is more reasonable and scientific, and adjustment is flexible.

In the main control system, the numbering module is configured to number athletes, the portrait input module is configured to enter identity images of the athletes, and the characteristic parameter input module is configured to input characteristic parameters of the athletes, where the characteristic parameters include ages, heights, and weights. The athlete data retrieving module is configured to retrieve athlete data in the main control system, the score matching module is configured to perform matching between a comprehensive score of the comprehensive scoring module and athlete data, and the result output module is configured to simultaneously correspondingly output a score and athlete data that correspond to an athlete, which may assist in managing a plurality of matches simultaneously. In addition, because a score corresponds to an athlete definitely, group assignment of a next match may be derived when statistics are collected on results, which effectively improves management and control capabilities in a competition arena, increases efficiency, and saves athlete assignment in each arena.

The modules in the foregoing electronic refereeing system for boxing may be implemented entirely or partially by software, hardware, firmware, or a combination thereof. The foregoing modules may be built in or independent of a processor of a computer device in a hardware form, or may be stored in a memory of the computer device in a software form, so that the processor invokes and performs an operation corresponding to each of the foregoing modules. When implemented by using software, the functions can be stored in a computer-readable medium or can be used as one or more instructions or codes on a computer-readable medium for transmission. When the one or more instruction or codes are executed by one or more processors, the foregoing modules are implemented. The computer-readable medium includes a computer storage medium and a communication medium, where the communication medium includes any medium that enables a computer program to be transmitted from one place to another. The storage medium may be any available medium accessible to a general-purpose or dedicated computer.

Figure 8:
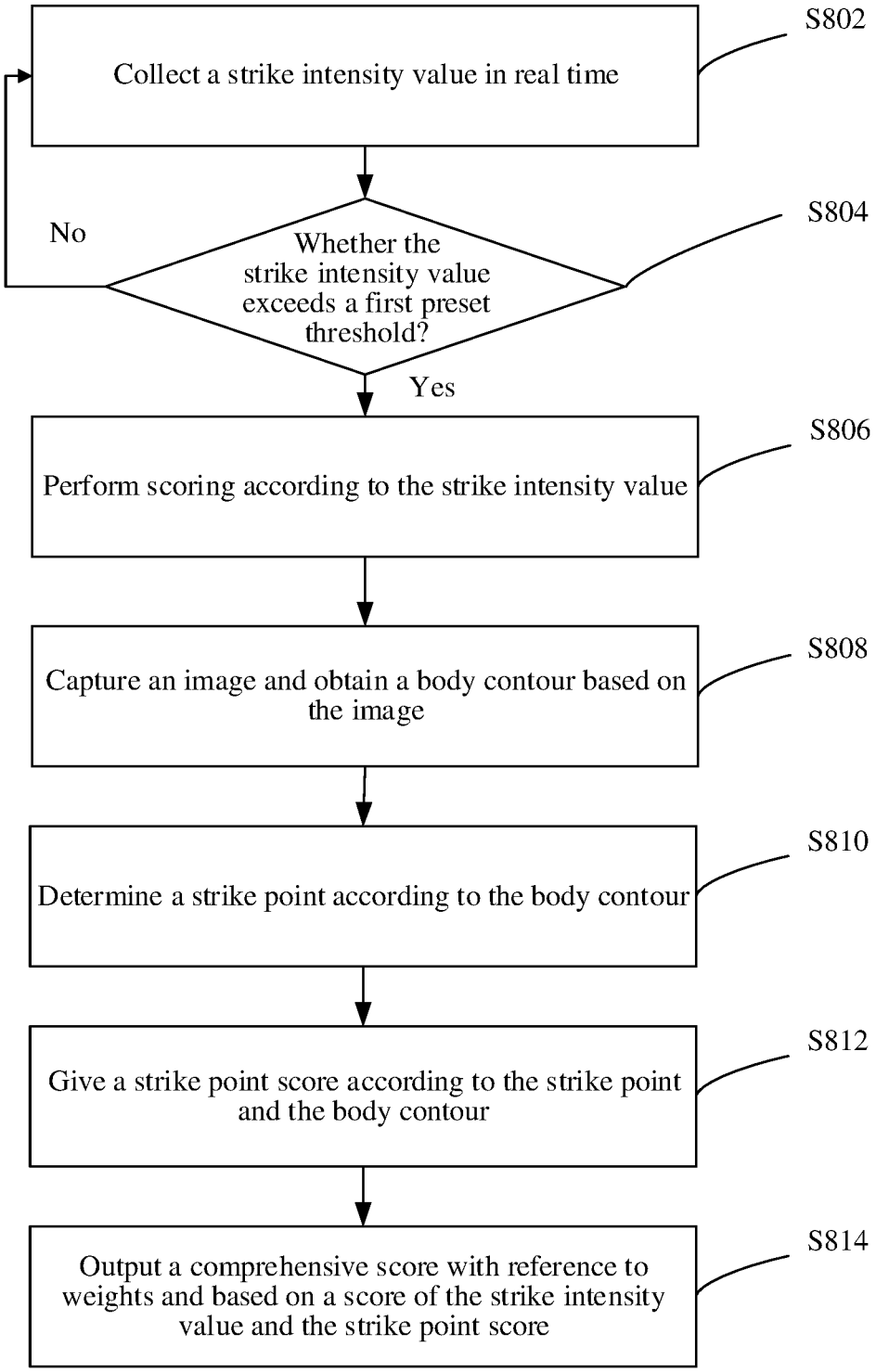
FIG. 8 is a schematic flowchart of an electronic refereeing method for boxing according to an embodiment of this application.

In some embodiments, as shown in FIG. 8, an electronic refereeing method for boxing is provided. This embodiment is described by using an example in which the refereeing method is applied to a terminal. It may be understood that the refereeing method may alternatively be applied to a server, and may alternatively be applied to a system including a terminal and a server and is implemented through interaction between the terminal and the server. In this embodiment, the refereeing method includes the following steps:

- S802: Collect a strike intensity value in real time.
- S804: Determine whether the strike intensity value exceeds a first preset threshold, and continue the refereeing method if the strike intensity value exceeds the first preset threshold, or otherwise return to the collecting a strike intensity value in real time until the strike intensity value exceeds the first preset threshold.
- S806: Perform scoring according to the strike intensity value.
- S808: Capture an image and obtain a body contour based on the image.
- S810: Determine a strike point according to the body contour.
- S812: Give a strike point score according to the strike point and the body contour.
- S814: Output a comprehensive score with reference to weights and based on a score of the strike intensity value and the strike point score.

In some embodiments, if the strike intensity value exceeds the first preset threshold, the performing scoring according to the strike intensity value includes:

- S8062: Set a plurality of strike intensity score thresholds.
- S8064: Compare the received strike intensity value with the plurality of strike intensity thresholds.
- S8066: Output a score corresponding to a maximum strike intensity threshold reached or exceeded by a strike intensity value as a current strike score.

In some embodiments, the giving a strike point score according to the strike point and the body contour includes:

- Step 8122: Divide the body contour found by scanning into a plurality of preset parts.
- Step 8124: Perform parameter setting on each preset part.

Step 8126: Select a closest preset part according to a received strike point to obtain a corresponding parameter that is a strike point score.

Figure 9:
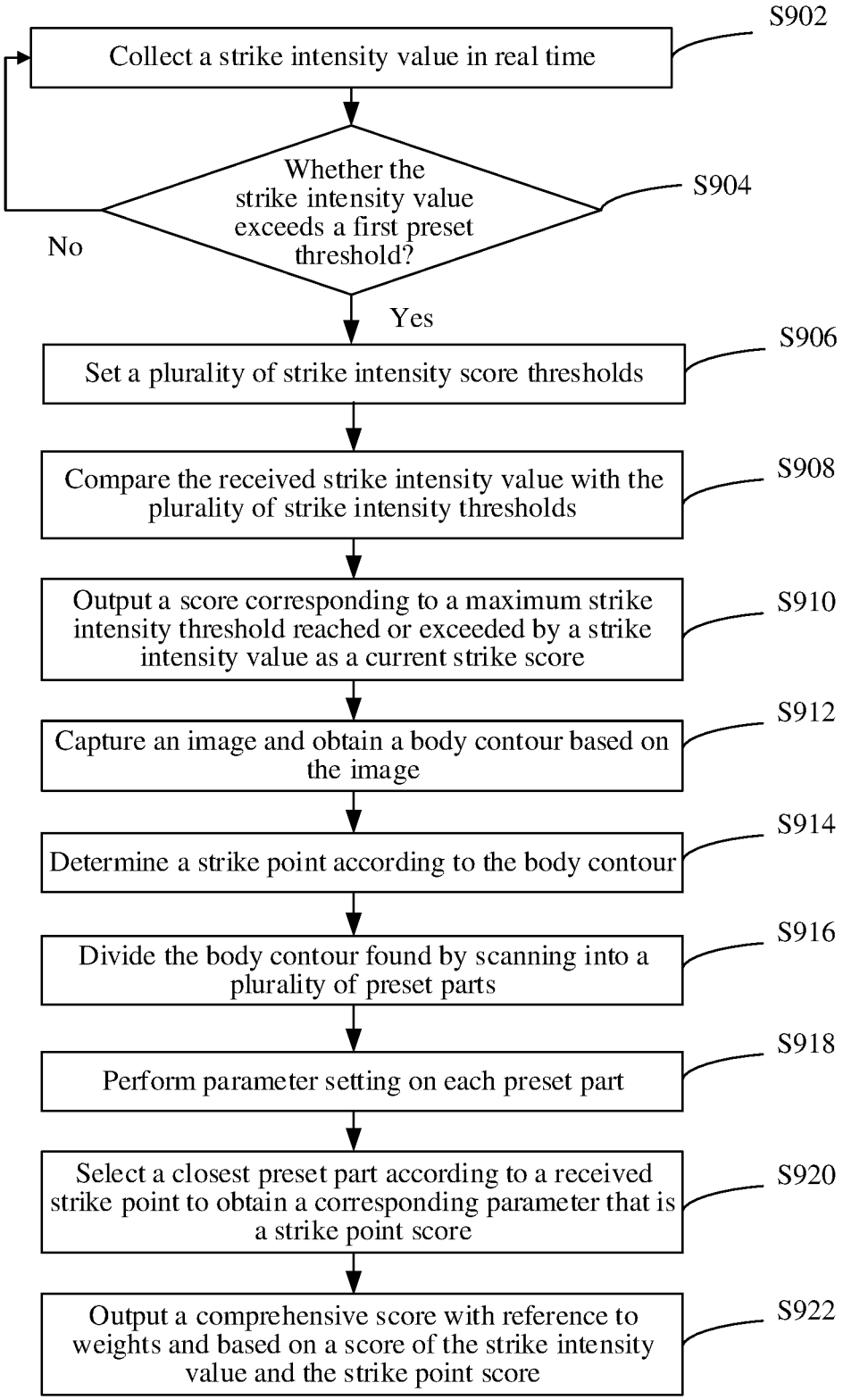
FIG. 9 is a schematic flowchart of another electronic refereeing method for boxing according to an embodiment of this application.

In some embodiments, as shown in FIG. 9, an electronic refereeing method for boxing is provided. The refereeing method includes the following steps:

S902: Collect a strike intensity value in real time.

S904: Determine whether the strike intensity value exceeds a first preset threshold, and continue if the strike intensity value exceeds the first preset threshold, or otherwise return to the collecting a strike intensity value in real time until the strike intensity value exceeds the first preset threshold.

S906: Set a plurality of strike intensity thresholds.

S908: Compare the received strike intensity value with the plurality of strike intensity thresholds.

S910: Output a score corresponding to a maximum strike intensity threshold reached or exceeded by a strike intensity value as a current strike score.

S912: Capture an image and obtaining a body contour based on the image.

S914: Determine a strike point according to the body contour.

S916: Divide the body contour found by scanning into a plurality of preset parts.

S918: Perform parameter setting on each preset part.

S920: Select a closest preset part according to a received strike point to obtain a corresponding parameter that is a strike point score.

S922: Output a comprehensive score with reference to weights and based on a score of the strike intensity value and the strike point score.

It should be understood that although the steps in the flowcharts of the foregoing embodiments are displayed sequentially according to instructions of arrows, these steps are not necessarily performed sequentially according to a sequence instructed by the arrows. Unless otherwise clearly specified in this specification, the steps are performed without any strict sequence limit, and may be performed in other sequences. In addition, at least some steps in the flowcharts of the foregoing embodiments may include a plurality of steps or a plurality of stages. The steps or the stages are not necessarily performed at the same moment, but may be performed at different moments. The steps or the stages are not necessarily performed in sequence, but may be performed in turn or alternately with another step or at least some of steps or stages of the another step.

In some embodiments, a computer-readable storage medium is provided. A computer program is stored on the computer-readable storage medium, and when the computer program is executed by a processor, the following steps are performed:

S802: Collect a strike intensity value in real time.

S804: Determine whether the strike intensity value exceeds a first preset threshold, and continue the refereeing method if the strike intensity value exceeds the first preset threshold, or otherwise returning to the collecting a strike intensity value in real time until the strike intensity value exceeds the first preset threshold.

S806: Perform scoring according to the strike intensity value.

S808: Capture an image and obtaining a body contour based on the image.

S810: Determine a strike point according to the body contour.

S812: Give a strike point score according to the strike point and the body contour.

S814: Output a comprehensive score with reference to weights and based on a score of the strike intensity value and the strike point score.

In some embodiments, a computer-readable storage medium is provided. A computer program is stored on the computer-readable storage medium, and when the computer program is executed by a processor, the following steps are performed:

S902: Collect a strike intensity value in real time.

S904: Determine whether the strike intensity value exceeds a first preset threshold, and continue if the strike intensity value exceeds the first preset threshold, or otherwise return to the collecting a strike intensity value in real time until the strike intensity value exceeds the first preset threshold.

S906: Set a plurality of strike intensity thresholds.

S908: Compare the received strike intensity value with the plurality of strike intensity thresholds.

S910: Output a score corresponding to a maximum strike intensity threshold reached or exceeded by a strike intensity value as a current strike score.

S912: Capture an image and obtaining a body contour based on the image.

S914: Determine a strike point according to the body contour.

S916: Divide the body contour found by scanning into a plurality of preset parts.

S918: Perform parameter setting on each preset part.

S920: Select a closest preset part according to a received strike point to obtain a corresponding parameter that is a strike point score.

S922: Output a comprehensive score with reference to weights and based on a score of the strike intensity value and the strike point score.

It should be noted that both information about a user (including but not limited to device information of the user, personal information of the user, and the like) and data (including but not limited to data used for analysis, data used for storage, data used for presentation, and the like) in this application are information and data that are authorized by the user or authorized fully by parties, and collection, use, and processing of the related data need to obey related laws, regulations, and standards of related nations and districts.

A person of ordinary skill in the art may understand that all or some of procedures of the refereeing method in the foregoing embodiments may be implemented by a computer program instructing relevant hardware. The computer program may be stored in a non-volatile computer-readable storage medium. When the computer program is executed, the procedures of the foregoing method embodiments may be implemented. Any reference to a memory, a database, or another medium used in the embodiments provided in this application may include at least one of a non-volatile memory and a volatile memory. The non-volatile memory may include a read-only memory (Read-Only Memory, ROM), a magnetic tape, a floppy disk, a flash memory, an optical memory, a high-density embedded non-volatile memory, a resistive random access memory (ReRAM), a magnetoresistive random access memory (Magnetoresistive Random Access Memory, a MRAM), a ferroelectric random access memory (Ferroelectric Random Access Memory, a FRAM), a phase change memory (Phase Change Memory, a PCM), a graphene memory, or the like. The volatile memory may include a random access memory (RAM), an external cache, or the like. For the purpose of description instead of limitation, the RAM is available in a plurality of forms, such as a static RAM (SRAM) or a dynamic RAM (DRAM). The database in the embodiments provided in this application may include at least one of a relational database and a non-relational database. The non-relational database may include a blockchain-based distributed database and the like, but is not limited thereto. The processor in the embodiments provided in this application may be a general-purpose processor, a central processing unit, a graphics processing unit, a digital signal processor, a programmable logic device, a data processing logic device based on quantum computing, or the like, but is not limited thereto.

The technical features in the foregoing embodiments may be randomly combined. For concise description, not all possible combinations of the technical features in the embodiment are described. However, provided that combinations of the technical features do not conflict with each other, the combinations of the technical features are considered as falling within the scope recorded in this specification.

The foregoing embodiments only describe several implementations of this application specifically and in detail, but cannot be construed as a limitation to the patent scope of this application. It should be noted that a person of ordinary skill in the art may make various changes and improvements without departing from the ideas of this application, which shall all fall within the protection scope of this application. Therefore, the protection scope of the patent of this application shall be subject to the appended claims.

What is claimed is:

1. An electronic refereeing system for boxing, the electronic refereeing system comprising:

a sensing module, a monitoring module, a comprehensive scoring module, a remote transmission module, and a main control system, wherein the main control system is connected to the comprehensive scoring module through the remote transmission module, and the comprehensive scoring module is connected to the sensing module and the monitoring module, wherein the sensing module is configured to perform a first scoring according to a strike intensity to rate a first score;

wherein the sensing module comprises an intensity scoring module and a strike intensity detection module, the strike intensity detection module is connected to a sensor mounted in a boxing glove and is configured to receive the strike intensity sensed by the sensor, and the intensity scoring module is configured to perform the first scoring according to the strike intensity;

wherein, in response to receiving a strike intensity value which exceeds a first preset threshold, the strike intensity detection module is configured to send the strike intensity value to the intensity scoring module, and send a current time stamp to the monitoring module to perform an image capture;

wherein the monitoring module is configured to perform a second scoring according to a strike point to rate a second score;

wherein the monitoring module comprises a body contour scanning module, a strike point marking module, and a score review module, the body contour scanning module is configured to capture an image in real time according to a received time stamp and scan the image to find a body contour, the strike point marking module is configured to mark the strike point according to the captured image and based on the body contour found by scanning of the body contour scanning module, and the score review module is configured to perform the second scoring according to the marked strike point; and wherein the comprehensive scoring module is configured to perform comprehensive calculation on the first score rated by the sensing module and the second score rated by the monitoring module in a weight calculation manner.

2. The electronic refereeing system for boxing according to claim 1, wherein the intensity scoring module in which a plurality of strike intensity thresholds are stored is configured to select a score corresponding to a maximum strike intensity threshold reached or exceeded by the strike intensity value as the first score of the strike intensity, and output the first score of the strike intensity to the comprehensive scoring module.

3. The electronic refereeing system for boxing according to claim 1, wherein the monitoring module further comprises a strike point score record module, and the strike point score record module is configured to record the strike point and the second score of the strike point, and output the second score of the strike point to the comprehensive scoring module.

4. The electronic refereeing system for boxing according to claim 3, wherein the score review module is configured to set a plurality of preset parts for the body contour found by scanning of the body contour scanning module, perform parameter setting on each preset part, select a closest preset part according to the strike point to obtain a corresponding parameter that is the second score of the strike point, and send the strike point and the second score of the strike point score to the strike point score record module.

5. The electronic refereeing system for boxing according to claim 1, wherein the comprehensive scoring module comprises a weight calculation module, a manual check module, and a final score output module, wherein the weight calculation module is configured to perform weight calculation according to the first score of the strike intensity rated by the sensing module and the second score of the strike point rated by the monitoring module to obtain a comprehensive score, the manual check module is configured to help a referee intervene in checking the comprehensive score to prevent a problem of an excessively a large error from occurring, and the final score output module is configured to output a finally checked score.

6. The electronic refereeing system for boxing according to claim 5, wherein a process of checking the comprehensive score is considering, in a case that a difference between a manually given score and a score given by the comprehensive scoring module is in a first predetermined range, that the score given by the comprehensive scoring module does not have the large error.

7. The electronic refereeing system for boxing according to claim 6, wherein the weight calculation module comprises a weight input module, and the weight input module is configured to assist in manually inputting and calculating a weight coefficient of the first score of the strike intensity and a weight coefficient of the second score of the strike point.

8. The electronic refereeing system for boxing according to claim 1, wherein the main control system comprises a display module, a voice module, and a storage module, the display module is configured to display a scoring result and a system running situation, the voice module is configured to broadcast prompt voice in a match, wherein the prompt voice comprises a match time record, a comprehensive score, a foul warning, match node broadcasting, and athlete information playing, and the storage module is configured to store data information.

9. The electronic refereeing system for boxing according to claim 1, wherein the main control system further comprises an athlete registration module; and the athlete registration module comprises a numbering module, a portrait input module, and a characteristic parameter input module, the numbering module is configured to number athletes, the portrait input module is configured to enter identity images of the athletes, and the characteristic parameter input module is configured to input characteristic parameters of the athletes, wherein the characteristic parameters comprise ages, heights, and weights.

10. The electronic refereeing system for boxing according to claim 1, wherein the main control system further comprises an athlete data retrieving module, a score matching module, and a result output module, the athlete data retrieving module is configured to retrieve athlete data in the main control system, the score matching module is configured to perform matching between a comprehensive score of the comprehensive scoring module and athlete data, and the result output module is configured to simultaneously correspondingly output a comprehensive score and athlete data that correspond to an athlete.

11. The electronic refereeing system for boxing according to claim 1, wherein the remote transmission module comprises a Wi-Fi module, and the Wi-Fi module is disposed between a data receive end and a data transmit end of the comprehensive scoring module and the main control system.

12. The electronic refereeing system for boxing according to claim 1, wherein the main control system comprises a penalty module, the penalty module comprises a violation item record module, a violation rating module, and a penalty amount calculation module, the violation item record module is configured to record a violation item according to an image captured and recorded by the monitoring module, the violation rating module is configured to perform rating according to the violation item, each rating corresponds to a different penalty amount, and the penalty amount calculation module is configured to perform summation according to a quantity of violation times and the penalty amount corresponding to each rating to obtain a final penalty amount.

13. A refereeing method for an electronic refereeing system for boxing, applied to an electronic refereeing system for boxing, wherein the electronic refereeing system for boxing comprises a sensing module, a monitoring module, a comprehensive scoring module, a remote transmission module, and a main control system, wherein the main control system is connected to the comprehensive scoring module through the remote transmission module, and the comprehensive scoring module is connected to the sensing module and the monitoring module;

the sensing module is configured to perform a first scoring according to a strike intensity to rate a first score;

wherein the sensing module comprises an intensity scoring module and a strike intensity detection module, the strike intensity detection module is connected to a sensor mounted in a boxing glove and is configured to receive the strike intensity sensed by the sensor, and the intensity scoring module is configured to perform the first scoring according to the strike intensity; and wherein in response to receiving a strike intensity value which exceeds a first preset threshold, the strike intensity detection module is configured to send the strike intensity value to the intensity scoring module, and send a current time stamp to the monitoring module to perform an image capture;

the monitoring module is configured to perform a second scoring according to a strike point to rate a second score; wherein the monitoring module comprises a body contour scanning module, a strike point marking module, and a score review module, the body contour scanning module is configured to capture an image in real time according to a received time stamp and scan the image to find a body contour, the strike point marking module is configured to mark the strike point according to the captured image and based on the body contour found by scanning of the body contour scanning module, and the score review module is configured to perform the second scoring according to the marked strike point; and the comprehensive scoring module is configured to perform comprehensive calculation on the first score rated by the sensing module and the second score rated by the monitoring module in a weight calculation manner;

the refereeing method comprising:

collecting a strike intensity value in real time;

determining whether the strike intensity value exceeds a first preset threshold, and continuing the refereeing method if the strike intensity value exceeds the first preset threshold, or otherwise returning to the collecting the strike intensity value in real time until the strike intensity value exceeds the first preset threshold;

performing the first scoring according to the strike intensity value to rate the first score of the strike intensity;

capturing an image and obtaining a body contour based on the image;

determining a strike point according to the body contour;

performing the second scoring according to the strike point and the body contour to obtain the second score of the strike point; and outputting a comprehensive score with reference to weights and based on the first score of the strike intensity and the second score of the strike point.

14. The refereeing method according to claim 13, wherein the performing the first scoring according to the strike intensity value comprises:

setting a plurality of strike intensity thresholds;

comparing the collected strike intensity value with the plurality of strike intensity thresholds; and outputting a score corresponding to a maximum strike intensity threshold reached or exceeded by the collected strike intensity value as the first score of the strike intensity.

15. The refereeing method according to claim 13, wherein the performing the second scoring according to the strike point and the body contour comprises:

dividing the body contour found by scanning into a plurality of preset parts;

performing parameter setting on each preset part; and selecting a closest preset part according to the strike point to obtain a corresponding parameter that is the second score of the strike point.

16. A non-transitory computer-readable storage medium, on which a computer program is stored, wherein when the computer program is executed by a processor, steps of the refereeing method according to claim 13 are implemented.

* * * * *